United States Patent [19]

Baker

[11] Patent Number: 4,517,956

[45] Date of Patent: May 21, 1985

[54] WOODBOX

[76] Inventor: Walter F. Baker, 2108 Randolph Cir., Kennesaw, Ga. 30144

[21] Appl. No.: 529,545

[22] Filed: Sep. 6, 1983

[51] Int. Cl.[3] ..... F24B 1/08; A47B 81/00

[52] U.S. Cl. ..... 126/283; 52/67; 232/43.3; 312/286

[58] Field of Search ..... 126/283; 312/283, 286, 312/211, 250, 236, 242; 52/67; 232/43.3

[56] References Cited

U.S. PATENT DOCUMENTS

| | | | |
|---|---|---|---|
| 1,348,623 | 8/1920 | Borchert | 312/286 |
| 1,458,024 | 6/1923 | Benson | 126/283 |
| 1,469,359 | 10/1923 | Craw | 312/286 |
| 2,709,635 | 5/1955 | Carani | 312/286 |
| 3,698,143 | 10/1972 | Francis | 312/286 |
| 4,245,776 | 1/1981 | Miner | 312/286 |

FOREIGN PATENT DOCUMENTS

| | | | |
|---|---|---|---|
| 875448 | 7/1971 | Canada | 232/43.3 |

*Primary Examiner*—James O. Yeung
*Attorney, Agent, or Firm*—Jones & Askew

[57] ABSTRACT

An improved woodbox for insertion into the exterior wall of a building has a load opening outside the building, a drawer within the woodbox that is loaded through the load opening and can be opened into the building for easy retrieval of wood from the drawer. The openings are constructed and sealed to provide an air lock which permits loading and unloading without heat loss from the interior of the building.

6 Claims, 4 Drawing Figures

WOODBOX

TECHNICAL FIELD

This invention relates to woodbox construction and installation and particularly to woodboxes for allowing energy efficient storage and retrieval of wood.

BACKGROUND ART

The energy efficient use of wood in a home or business fireplace embraces a great variety of problems. One of the problems encountered by a home owner or other operator of a fireplace is that of energy efficiency in storing and retrieving the wood fuel. First, the wood has to be stored outside of the home in a position so as to protect the wood from the elements. Second, the wood must then be transported manually from this position outside the home to a position near the fire to enable the subsequent fueling of the fire. Third, the manual transfer of the wood from the outside to inside requires the opening and closing of an entry and exit doorway for every arm-load of wood. Since heat escapes when a door is opened, requiring the operator of the fireplace to manually transport the wood through a doorway results in a considerable amount of energy loss and inconvenience. The inconvenience is a direct consequence of the continued exposure of the operator to the climatic conditions existing outside of the home, which at a minimum can involve continued re-adaptation to varying temperature levels, as well as the time involved in manually transfering the wood.

No known wood storage devices are capable of solving the problem of storing readily accessible fire wood for subsequent use in a fireplace located in the interior of a building. All known devices entail the manual transportation of the wood through a door in the house by the operator. Prior systems cannot energy efficiently store the wood and allow for the ready retrieval of the wood, all without the operator's exit from the house for the purpose of retrieving the wood, because they lack several features. First, the system should be capable of storing a large amount of wood so as to allow the operator to fuel a fire for a sufficiently long period of time. Second, the system should keep the wood free from moisture that would tend to inhibit the drying or combustion of the wood. Third, the system should be accessible from the interior of the house for retrieving the wood and accessible from the outside for storing the wood therein. Fourth, the system should be easily operable so as to enable an ordinary person to retrieve the wood. Fifth, the system should be sealed and insulated so as to reduce the heat loss through the system itself when not in operation.

Previously there have been provided cabinets capable of allowing the deposit of goods and the subsequent retrieval by means of an alternate door. U.S. Pat. No. 4,245,776 discloses a pass-through drawer assembly with cam attached doors for the primary use in banking and food applications. For example, an operator inside a structure could lower an item into the drawer through an opening in an inner housing and then cause the drawer to travel through a wall for unloading by a customer. U.S. Pat. No. 1,469,359 discloses a free standing cabinet that sits in a doorway allowing deposit of goods by vendors while a homemaker is away, and subsequent retrieval by the homemaker. The present invention improves upon these concepts by providing an energy efficient means for storing large quantities of wood outside an enclosed space with the ability to allow for the transfer of the wood into the enclosed space by an operator standing inside the enclosed space.

SUMMARY OF THE INVENTION

The present invention provides a wood storage and retrieval device which solves problems experienced in the prior art by utilizing a woodbox having particular features in combination with a drawer accessible from both the inside and outside of an enclosed space or structure, such as a home. The woodbox is intended to be mounted in an exterior wall of the enclosed space such that quantities of wood may be deposited into the woodbox through an opening accessible to the operator while standing outside the enclosed space and retrieved later through an opening accessible to the operator while standing inside the enclosed space.

The woodbox, for installation into the structure defining the enclosed space, has top, bottom, side and rear surfaces and is mounted in such a way that the front end of the woodbox extends through an exterior wall into the interior of the enclosed space. This front end of the woodbox defines the retrieval opening, exposing the interior of the woodbox.

The top surface of the woodbox defines a second opening to the interior of the woodbox. The top surface opening is surrounded by a vertical flange that rises vertically from the top surface. A removable cover is mounted over the top surface. The cover consists of a top plate with a continuously encompassing vertical side wall extending therefrom. The top plate in combination the vertical side wall completely covers and encompasses the top surface opening and vertical flange. The side wall of the cover plate extends vertically to a point where it is in continuous contact with the top surface of the woodbox. The cover is hinged on one side of its vertical side wall such that the operator may lift the cover to one side in order to gain access to the top surface opening.

The cover in combination with the vertical flange of the top surface opening forms a means for prohibiting the entry of water and inhibiting the entry of air into the interior of the woodbox. At the top edge of the vertical flange a gasket seal can be mounted so as to come into contact with the underside of the cover plate when the cover is in the closed position. This gasket seal further restricts the flow of air through the woodbox. Alternately, or in addition, a second seal is mounted at the bottom edge of the vertical side wall of the cover so as to come into contact with the top surface of the woodbox when the cover is in the closed position.

A drawer having floor, side and back walls shaped to be movable through the retrieval opening is mounted inside the woodbox. The drawer is mounted on the two kinds of rollers. Rear casters are attached directly to the drawer and move upon a track that is mounted on the bottom surface adjacent to the sides of the woodbox. This track is specially designed to prohibit vertical or horizontal displacement of the casters in a direction perpendicular to the normal motion of the drawer. The second kind of roller is mounted directly onto the bottom surface inside the woodbox near the retrieval opening. A track mounted on the underside of the drawer runs along these front rollers.

On the front of the drawer is mounted a drawer face plate. The face plate extends outwardly beyond the top, bottom and side surfaces of the woodbox. The face plate encounters the edges of the top, bottom and side surfaces when the drawer is in the closed position. On the backside of the face plate a gasket seal can be continuously mounted to engage the edges of the woodbox surfaces to seal the front of the woodbox when the drawer is in the closed position. A handle is mounted on the face plate providing pulling and lifting means to enable full use of the drawer.

The back wall of the drawer is designed so as to provide blocking means to prohibit the accidental removal of the drawer in its fully extended position from the woodbox. A drawer blocking plate extending upwardly from the back wall of the drawer comes into contact with a second blocking plate extending downwardly from the top surface of the woodbox, when the drawer is fully extended. Such contact can be avoided and the drawer removed by lifting the front of the drawer vertically with the handle device on the front face plate of the drawer, thereby allowing the drawer to slide under the blocking plate that is attached to the woodbox structure.

Bracketing means is provided to secure the woodbox to the exterior wall of the enclosed space. Two L-shaped brackets may be used in combination to secure the woodbox. The brackets are attached to a surface of the woodbox, each bracket on an opposite side of the exterior wall. A pass-through bolt passing through the wall and securely attached to each bracket secures the woodbox to the exterior wall.

Means for horizontally leveling the woodbox is provided at the rear of the woodbox. Supports extend vertically downward from the woodbox to the ground at a height selected to horizontally level the rear end of the woodbox with the point of attachment to the enclosed space.

Thus, it is an object of the present invention to provide an improved woodbox.

It is a further object of the present invention to provide an energy efficient woodbox allowing the operator a reaily accessible supply of wood for subsequent use in a fireplace. The present invention allows an operator to store wood and then retrieve the wood without the loss of energy or the inconvenience of entry and exit through a doorway in an enclosed space.

It is a further object of the present invention to provide an air lock between the interior and exterior of the enclosed area so as to prevent loss of heat resulting from convection and air drafts during wood retrieval.

DETAILED DESCRIPTION

Figure 1:
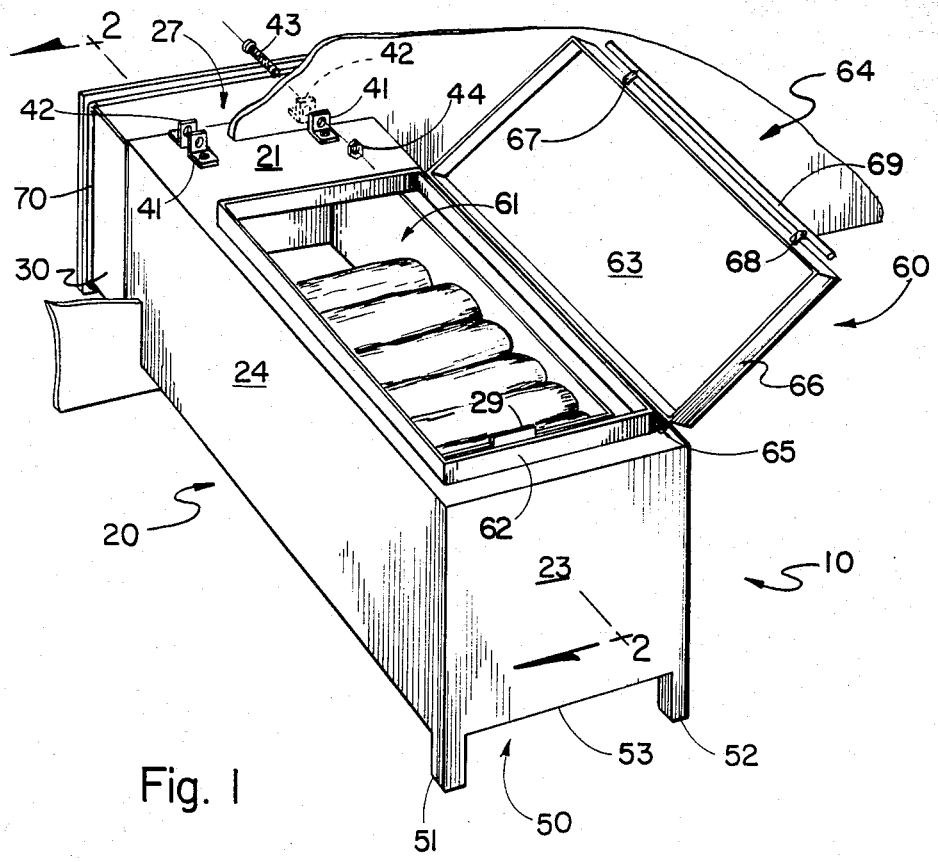
FIG. 1 is a pictorial view of a woodbox embodying the invention, showing portions of structure broken away to expose interior detail.
Figure 4:
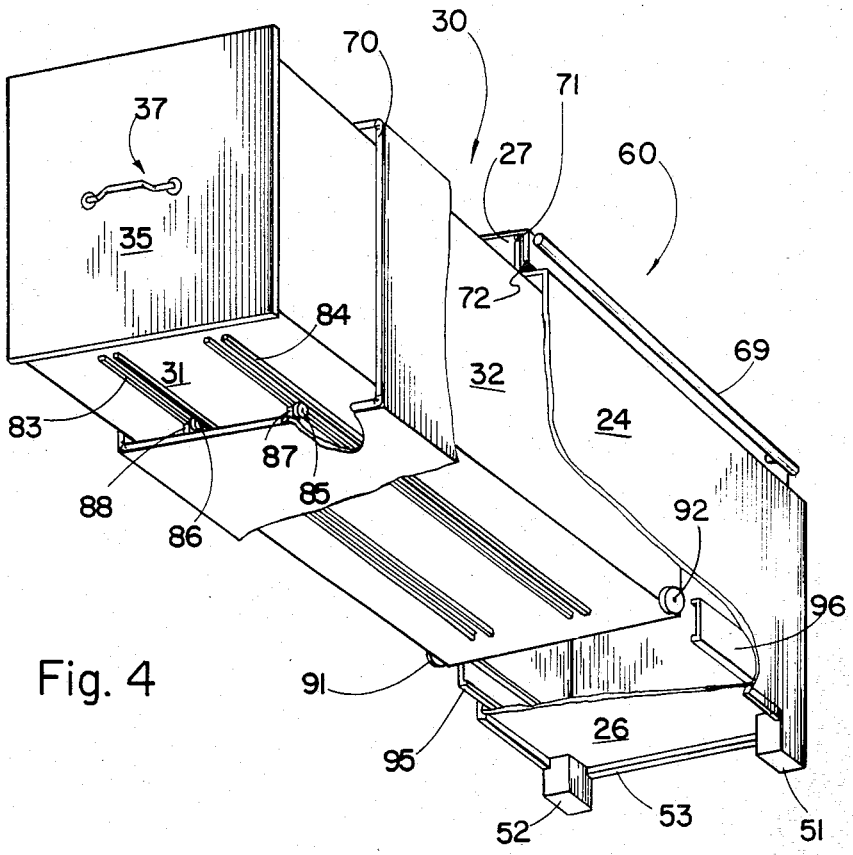
FIG. 4 is a lower pictorial view of a woodbox embodying the invention, showing the drawer extended and portions of the woodbox surfaces broken away.

Referring now in more detail to the drawings, FIG. 1 shows a woodbox 10 comprising a rigid enclosure or housing 20, a movable drawer assembly 30, bracket means 40, support means 50, and cover means 60. The woodbox 10 is mounted in the exterior wall 100 of a building. The rigid enclosure 20 comprises a top surface 21 solidly connected at right angles to a rear wall 23, left side wall 24, and right side wall 25. Similarly the rear wall 23 is solidly connected at right angles to left side wall 24, right side wall 25, and top surface 21. The rigid enclosure includes a bottom surface 36, shown in FIG. 4, rigidly connected at right angles to rear wall 23, left side wall 24 and right side wall 25. Preferably the rigid connections mentioned above are continuous welds so as to seal the inside of the rigid enclosure 20 from exposure to moisture or air drafts. The rigid enclosure 20 thus defines a box-like strucure having top 21 and bottom 26 surfaces, rear wall 23, and side walls 24 and 25, preferably constructed of sheet metal or another rigid sheet material. The rigid enclosure 20 defines an opening 27 at the front of the box-like structure wherein the movable drawer assembly 30 may be inserted in a manner described in detail below.

The top surface 21 defines an opening 61 continuously surrounded by a four-sided upstanding flange 62. Preferably the vertical flange 62 is rigidly mounted by welding to the edge of the opening 61 so as to provide means for prohibiting the seepage of moisture into the interior of the woodbox 10. The opening 61 is of sufficient size to permit manual lowering of logs into the woodbox.

The cover 60 is mounted directly above opening 61 thereby providing means for sealing off the interior of the woodbox 10. The cover 60 comprises a rectangular cover plate 63 having a continuous downwardly depending side wall 66 attached to its edges. A hinge 65 connects one lower edge of the side wall 66 to the top surface 21 adjacent to the opening 61. A handle 64 is mounted on the portion of the side wall 66 opposite the hinge 65 so as to provide a means for raising and lowering the cover 60. Preferably, the handle 64 comprises two supports 67 and 68, rigidly connected to an elongate bar 69. The supports 67 and 68, rigidly connected to flange 66, extend outwardly from flange 66. The bar 69 runs parallel to the portion of flange 66 on which supports 67 and 68 are attached.

A pair of continuous gaskets 71 and 72 are preferably utilized to form a seal so as to restrict air drafts and moisture leaks. The gasket 71 is preferably mounted on the top edge of flange 62, and engages the underside of cover 63 along a path inside the location of the side wall 66. Cover gasket 72 is mounted on the lower exposed edge of side wall 66 so as to engage top surface 21 along a path exterior of flange 62. The gaskets 71 and 72 are formed of conventional gasket material of sufficient strength and longevity when exposed to the weather to restrict air drafts and moisture seepage between the environment and the interior of woodbox 10 for a considerable time before replacement may be required.

The support means 50 includes legs 51 and 52 which extend from a frame 53 which underlies and supports the woodbox 10. The frame 53 is rigidly connected to rigid enclosure 20 so as to reinforce the walls therefore under a heavy load of wood. The height of legs 51 and 52 is adjusted depending on the distance from the woodbox to the ground, so as to enable the woodbox 10 to stand level when installed in an exterior wall of the building. Alternative known bracing methods can be utilized so as to lend support to the rigid enclosure 20 and drawer assembly 30.

The bracket means 40 includes at least one exterior bracket 41 and at least one interior bracket 42. The brackets are provided in pairs, each pair having an exterior bracket attached to a surface of the rigid enclosure 20 outside the building and an interior bracket attached to the same surface inside the building. Preferably the exterior bracket 41 is L-shaped and attached to the top surface 21 adjacent to an exterior surface 101 of the building wall 100 by means of a bolt and nut attachment or welding (not shown). Similarly the bracket 42 is attached to the top surface 21 adjacent to an interior surface 102 of the wall 100. Brackets 41 and 42 are attached together by means of a long bolt 43 that runs through an opening drilled in the exterior wall 100 of the building and through aligned openings in the brackets 41 and 42. The pass through bolt 43 is threaded at one end and secures the brackets 41 and 42 to the wall 100 by means of a nut 44. It will be appreciated that alternative means may be employed to secure the front of the rigid enclosure 20 into the exterior wall 100 of the building, with the opening 27 opening into the interior of the building. For stability, bracket sets 41 and 42 can be provided on the side or bottom surfaces of the enclosure 20, in addition to or in place of those on the top surface.

Figure 2:
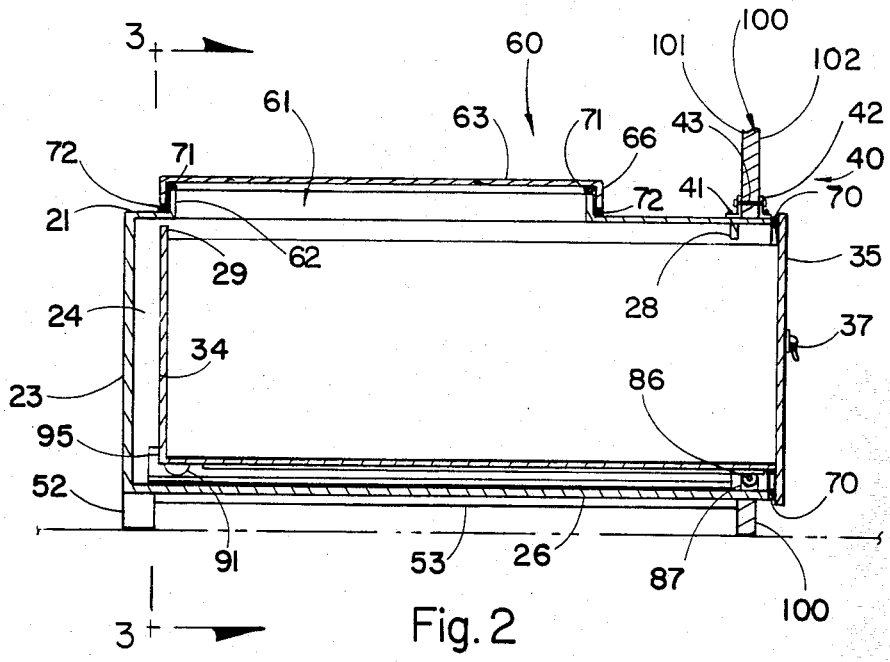
FIG. 2 is a longitudinal vertical cross-sectional view of the woodbox of FIG. 1.
Figure 3:
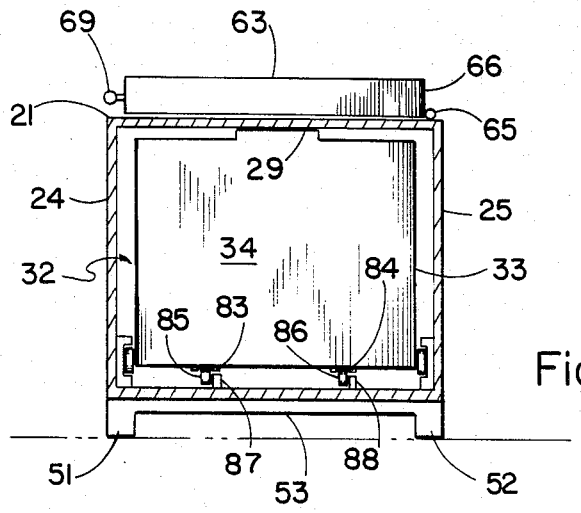
FIG. 3 is a transverse vertical cross-sectional view of the woodbox of FIG. 1, taken along line 3—3 of FIG. 2.

The drawer assembly 30 is capable of transfering the heavy weight of a load of wood. The drawer 30, shown in FIGS. 2-4, comprises a bottom surface 31 rigidly connected at right angles to a left side wall 32, a right side wall 33, a rear wall 34, and a front face plank 35. The front face plate 35 is similarly rigidly connected at right angles to side walls 32 and 33 and bottom surface 31. Drawer assembly 30 members 31, 32, 33 and 34 thus form an open-top box-like enclosure of sheet metal or the like shaped to be received in the opening 27 of the enclosure 20. Preferably the front face plate 35 encompasses the entire area defined by opening 27 so as to provide a means for sealing off the interior of woodbox 10 from the interior of the building when drawer assembly 30 is in a closed position, as shown in FIG 2. More particularly, face plate 35 extends to allow concealment of opening 27, extending beyond the front edges of top surface 21, side walls 24 and 25 and bottom surface 26 of the enclosure 20 so as to form a seal to prohibit air drafts between woodbox 10 and the interior of the house. Face plate 35 includes handle means 37 whereby drawer assembly 30 may be manually operated in a manner described below.

A gasket 70 is attached to the front edge of rigid enclosure 20, including the front edge of top surface 21, front edges of side walls 23 and 24 and front edge of bottom surface 26, and is positioned so as to come into contact with the backside of face plate 35 when drawer assembly 30 is in the closed position. The gasket 70 is of sufficient constitution to prohibit air drafts and moisture seepage between the woodbox 10 and the interior of the building.

If desired, the underside of the bottom surface 31 of the drawer 30 includes two gliding and support tracks 83 and 84 mounted in spaced apart relation extending at right angles to the face plate 35. Tracks 83 and 84 are rigidly mounted longitudinally along the length of bottom surface 31 of drawer 30. Preferably tracks 83 and 84 are downwardly opening U-shape tracks to run on rollers as described below.

A pair of rear casters or rollers 91 and 92 are rotatably mounted at the rear bottom of the side walls 33 and 32, respectively, of drawer 30. A pair of tracks 95 and 96 for receiving the casters 91 and 92 are rigidly mounted in the interior of rigid enclosure 20 along the joints between the bottom surface 26 and the side walls 24 and 25 of the enclosure. Tracks 95 and 96 are C-shaped tracks opening to the interior of the rigid enclosure 20, thereby facing drawer 38 and retaining the rear casters 91 and 92. The tracks 95 and 96 run longitudinally the length of drawer 30 when drawer 30 is in the retracted position, thereby providing tracks for rear casters 91 and 92 during normal movement of the drawer 30. Tracks 95 and 96 are open-ended at the front edge to allow rear casters 91 and 92 to be removed from tracks 95 and 96 as described below.

In order to prevent drawer 30 from being inadvertently removed from rigid enclosure 20 a stopping means is utilized. A drawer flange 29 is rigidly mounted to extend vertically above rear wall 34. A stationary flange 28 is mounted to the underside of top surface 21 near the front of rigid enclosure 20, and extends vertically downward from top surface 21. Drawer flange 29 and stationary flange 28 are constructed and mounted so as to come into contact when drawer 30 is fully extended during normal operation. Drawer 30 is fully extended for wood removal when drawer flange 29 and stationary flange 28 come into contact, at which time the interior of drawer 30 is accessible to the interior of the house, and rear casters 91 and 92 are adjacent to the front ends of the tracks 95 and 96.

To enable removal of drawer 38 for cleaning purposes, drawer flange 29 and stationary flange 28 can be moved to avoid one another as the drawer is being removed from the rigid enclosure 20. Removal of the drawer 30 is accomplished by tilting the front of the drawer 30, when fully extended, upwardly by lifting the handle means 37. When thus tilted, the flange 28 is positioned below flange 29, allowing drawer 30 to be pulled forward by handle means 37 until the rear casters are removed from the tracks 95 and 96 and the drawer 30 is completely removed from rigid enclosure 20. Drawer 30 may be installed again into the enclosure 20 by reversing the removal steps just described. It will be appreciated that other means could be provided for selectively permitting removal of the drawer.

In order to support the front of the drawer 30 and facilitate its movement, a pair of front casters or rollers 85 and 86 are rotatably mounted on supports 87 and 88 to the bottom 26 of the enclosure 20 near the opening 27 and directly under the tracks 83 and 84. Thus, the weight of the drawer 30 and its contents are distributed between the front and rear casters which run freely and precisely along tracks. Alternative possible methods of mounting front casters 85 and 86 will be appreciated, such as an axle.

The woodbox 10 is designed to be installed into an exterior wall of a house or other structure. To provide for installation a hole must be cut into the exterior wall 100 so as to allow insertion of the woodbox 10. Known carpentry techniques are used to brace the wall sufficiently to support woodbox 10. Rigid enclosure 20 with cover means 60 pre-attached is inserted into the prepared opening in the exterior wall 100. The length of legs 51 and 52 is provided so as to level the woodbox 10 to the desired position, depending on how far above ground level the woodbox enters the structure. Holes are drilled for bolts 43, and brackets 41 and 42 are then attached to the woodbox and to each other through the wall to secure the woodbox 10 to the exterior wall 100. Caulking or the like can be applied where the woodbox meets the exterior and interior surfaces of the wall 100. The drawer is then inserted by tilting the drawer to clear flange 28 and by placing the casters 85 and 86 into tracks 95 and 96. Drawer 30 can then be slid into the opening 27, forming a complete woodbox 10 ready for use.

To use the woodbox 10 an operator conveniently loads wood fuel into the woodbox 10 from the exterior of the building by raising the cover 60 and depositing the wood into the woodbox 10 through opening 61. At this time the drawer gasket 70 prevents heat loss from the building. The operator then lowers the cover 60 so as to secure the wood from moisture and to prevent subsequent heat loss via air drafts. The woodbox 10 is thus sealed to protect the wood from exposure to elements in the environment and provides an air lock to restrict heat loss via air drafts from the interior of the building. The operator (or another person in the building) can then make one entry, subsequent to the operator's one exit for loading, into the house to remove wood as needed from the woodbox to supply fuel to a fire. To remove wood from the woodbox the operator merely pulls on the drawer handle to roll out the fully loaded drawer 30 for wood removal. At this time the cover gaskets 71 and 72 prevent heat loss from the building. Once the necessary wood is removed the drawer may be reinserted into the rigid enclosure by merely pushing the drawer at the face plate 35 thereby causing the drawer to be rolled back into the enclosure with the face place abutting the front of the interior wall. The gasket 70 surrounding the face plate seals the woodbox at the front edges of the rigid enclosure to prevent any air leaks.

If access to the interior of the woodbox is desired, for example, for cleaning, the drawer 30 may be removed simply by pulling the drawer out as far as possible until the flanges 28 and 29 stop this forward motion. Then by tilting the drawer by the front face plate the drawer may be slid completely out of the enclosure. The tilting motion causes the rear wall flange 28 to pass under the enclosure flange 29 allowing the drawer to be completely removed.

The advantages of the present invention include a novel means of storing wood so as to be accessible from the inside of a house or other structure. Wood fuel may be loaded into the woodbox through an opening in the woodbox outside of the house or structure. Subsequently the wood may be used to fuel a fire in the interior of the house without traveling outside the home or structure to obtain the fuel. Such a means of storing wood allows the operator to make only one exit and entry to fuel a fire for an extended period. The prior art requires the operator to make numerous trips to continually fuel a fire. Such trips not only entail time and effort on the part of the operator but also heat loss through the opening and closing of the doorway through which the operator must exit and enter. The present invention allows for the storage of wood in a moisture proof woodbox and the subsequent use of the wood fuel without intermittent loss of interior heat or climatic exposure of the operator.

While this invention has been described in detail with particular reference to a preferred embodiment thereof, it will be understood that variations and modifications can be made without departing from the spirit and scope of the invention as described herein and defined in the appended claims.

I claim:

1. A wood box for installation into an enclosed structure having an exterior wall, comprising:

a housing including top, bottom, side and rear surfaces, said top, bottom and side surfaces partially extending through said exterior wall of the enclosed structure thereby defining a retrieval opening in said housing opening to the interior of the enclosed structure, and said top surface defining a load opening therein outside of the enclosed structure;

a vertical flange extending upwardly from said top surface and surrounding said load opening;

a removable cover including a continuous downwardly extending cover side wall, said cover enveloping said vertical flange when said cover is in a closed position; and a movable drawer assembly including a drawer comprising floor, back and side walls shaped to be received within said retrieval opening, and a face plate extending laterally outwardly beyond said retrieval opening, said movable drawer assembly including means for slidably mounting said drawer for movement between a closed position in which said drawer is located below said load opening and said face plate engages said top, bottom and side surfaces of said housing, and an open position in which the drawer is accessible to the interior of said structure.

2. The woodbox of claim 1, further comprising first gasket means for sealing said removable cover in its closed position; and second gasket means for sealing said retrieval opening when said drawer is in its closed position, whereby the interior of said structure is sealed from the exterior both during loading of said woodbox and during retrieval of wood from said woodbox.

3. The woodbox of claim 1 further comprising bracket means including:

at least one inner bracket mounted to a surface of said housing, extending outwardly therefrom adjacent to the interior surface of said exterior wall;

at least one outer bracket mounted to said surface of said housing, extending outwardly therefrom adjacent to the exterior surface to said exterior wall; and means passing through said exterior wall for connecting said inner and outer brackets to secure said housing to said structure, said connecting means including a bolt passing through said exterior wall and being attached to said inner and outer brackets.

4. The woodbox of claim 1 further comprising support means including at least two legs supporting said housing level with the interior of the enclosed structure, said legs extending vertically downward from the rear corners of said housing.

5. The woodbox of claim 1 wherein said means for slidably mounting said drawer comprises:

at least two front casters mounted near said retrieval opening, said front casters being rotatably mounted on the bottom surface of said housing under the path of said drawer;

two rear casters, said rear casters being rotatably mounted at the rear bottom of said side walls of said drawer; and two rear caster tracks for receiving said rear casters, said tracks having an inwardly opening C-shape and being positioned along the joints between the bottom and side surfaces of said housing.

6. The woodbox of claim 2, wherein said second gasket means comprises:

a continuous gasket adhesively mounted onto the back side of said face plate, said gasket sealing the interior of said woodbox from the interior of the enclosed structure when said face plate abuts the front edges of said top, bottom and side surfaces of said rigid housing.

* * * * *